US006065937A

United States Patent [19]

Hunt

[11] Patent Number: 6,065,937

[45] Date of Patent: May 23, 2000

[54] HIGH EFFICIENCY, AXIAL FLOW FAN FOR USE IN AN AUTOMOTIVE COOLING SYSTEM

[75] Inventor: Alexander Graham Hunt, London, Canada

[73] Assignee: Siemens Canada Limited, Mississauga, Canada

[21] Appl. No.: 09/095,059

[22] Filed: Jun. 10, 1998

Related U.S. Application Data

[63] Continuation-in-part of application No. 09/017,604, Feb. 3, 1998.

[51] Int. Cl.[7] ..... F04D 29/38

[52] U.S. Cl. ..... 416/189; 416/169 A; 416/238; 416/DIG. 5

[58] Field of Search ..... 416/189, 192, 416/237, 235, 238, 236 A, 169 A, DIG. 5; 415/173.5, 173.6

[56] References Cited

U.S. PATENT DOCUMENTS

| | | | |
|---|---|---|---|
| 16,517 | 2/1857 | Marshall . | |
| 562,020 | 6/1896 | Peabody . | |
| 1,062,258 | 5/1913 | Schlotter . | |
| 1,408,715 | 3/1922 | Seelig et al. . | |
| 1,795,588 | 3/1931 | Wilson . | |
| 1,993,158 | 3/1935 | Funk | 230/120 |
| 2,154,313 | 4/1939 | McMahan | 230/274 |
| 2,219,499 | 10/1940 | Troller | 230/120 |
| 2,397,169 | 3/1946 | Troller et al. | 230/117 |
| 2,628,019 | 2/1953 | Koch | 230/274 |
| 2,687,844 | 8/1954 | Woodward | 230/117 |
| 3,168,235 | 2/1965 | Valdi | 230/120 |
| 3,173,604 | 3/1965 | Sheets et al. | 230/120 |
| 3,481,534 | 12/1969 | Price | 230/274 |
| 3,680,977 | 8/1972 | Rabouyt et al. | 415/172 |
| 3,995,970 | 12/1976 | Nobuyuki | 415/119 |
| 4,181,172 | 1/1980 | Longhouse | 165/51 |
| 4,329,946 | 5/1982 | Longhouse | 123/41.49 |
| 4,358,245 | 11/1982 | Gray | 416/139 |
| 4,396,351 | 8/1983 | Hayashi et al. | 415/172 |
| 4,459,087 | 7/1984 | Barge | 417/356 |
| 4,548,548 | 10/1985 | Gray, III | 416/189 |
| 4,915,588 | 4/1990 | Brachett | 416/189 |
| 5,244,347 | 9/1993 | Gallivan et al. | 416/189 |
| 5,326,225 | 7/1994 | Gallivan et al. | 416/179 |
| 5,399,070 | 3/1995 | Alizadeh | 416/189 |
| 5,577,888 | 11/1996 | Capdevilla et al. | 416/189 |
| 5,730,583 | 3/1998 | Alizadeh | 416/189 |

FOREIGN PATENT DOCUMENTS

| | | |
|---|---|---|
| 29 13 922 | 10/1980 | Germany . |
| 1150409 | 4/1995 | Russian Federation . |

*Primary Examiner*—Edward K. Look
*Assistant Examiner*—Richard Woo

[57] ABSTRACT

A high efficiency axial flow fan includes a hub, fan blades and a circular band. The hub rotates about a rotational axis when torque is applied from a shaft rotatably driven by a power source. The circular band is concentric with the hub, connected to the tip of each blade, and is spaced radially outward from the hub. The blades are configured to produce an airflow when rotated about the rotational axis. Each blade has a chord length distribution, stagger angle and dihedral (axial) distance which varies along the length of the blade. The dihedral distance of each blade varies as a function of blade radius from the rotational axis.

36 Claims, 4 Drawing Sheets

HIGH EFFICIENCY, AXIAL FLOW FAN FOR USE IN AN AUTOMOTIVE COOLING SYSTEM

This is a Continuation-in-Part of application Ser. No. 09/017,604, filed Feb. 3, 1998, which is incorporated by reference in its entirety herein.

FIELD OF THE INVENTION

The invention generally relates to axial flow fans for use in cooling systems. The invention particularly relates to a low noise, high efficiency, axial flow fan having an improved blade shape which minimizes the noise output of the fan while maintaining high efficiency with respect to air throughput and cooling.

BACKGROUND OF THE INVENTION

An axial flow fan may be used to produce a flow of cooling air through the heat exchanger components of a vehicle. For example, an airflow generator used in an automotive cooling application may include an axial flow fan for moving cooling air through an air-to-liquid heat exchanger such as an engine radiator, condenser, intercooler, or combination thereof. The required flow rate of air through the fan and change in pressure across the fan vary depending upon the particular cooling application. For example, different vehicle types or engine models may have different airflow requirements, and an engine or transmission cooler radiator may have different requirements than an air conditioner.

In general, when air moves axially through an unobstructed circular cylinder or tube, its flow is hindered mainly by friction from the wall of the cylinder and by turbulence from air moving radially from one portion of the cylinder to another. Thus, air moves faster down the center of a tube and slower in the concentric volumes closer to the tube's walls. The complexity of such air flow has been studied extensively. Even more complex is the flow of air through cylinders which have obstructions within them. Such obstructions may include motors as well as fan hubs and blades themselves. For example, axial flow ducted automotive cooling fans exhibit complex air flow because the duct is obstructed by the fan motor, hub and blades within it.

Specifically, both the fan blades and the hub, or the hub in combination with a drive motor and blades, are obstructions to the passage of air through the duct. The complexity of the flow is due largely to the interaction of the air with the obstructing surfaces. For instance, the fan hub directs air radially outward into concentric volumes away from the center of rotation while the cylinder walls direct air toward the center of the duct. The fan blades direct air both axially through the duct, and obliquely and radially outward toward the wall of the duct and into concentric volumes away from the center of rotation. Thus, in an axial flow fan, the concerted effect of the cylinder wall, fan blades and fan hub is to direct air into and move it through a doughnut-shaped "flow zone." The radial and oblique flow of air in the cylinder sometimes increases turbulence in the duct.

To provide adequate cooling, a fan should have performance characteristics which meet the flow rate and pressure rise requirements of the particular automotive application. For example, some applications impose low flow rate and high pressure rise requirements while other applications impose high flow rate and low pressure rise requirements. The fan must also meet the dimensional constraints imposed by the automotive engine environment, as well as the power efficiency requirements with respect to the fan drive motor, which is typically electric.

Accordingly, there is a need for an improved fan for moving air in vehicle cooling systems with high efficiency and having a low weight as well as a high strength to weight ratio. There is similarly a need to provide an axial flow fan which has performance characteristics meeting the requirements imposed by various automotive applications. Further, it is desirable to provide a fan capable of covering a broad range of automotive applications.

SUMMARY OF THE INVENTION

The invention relates to a fan rotatable about a rotational axis including a plurality of radially-extending fan blades configured to produce an airflow when rotated about the rotational axis.

The invention also relates to a fan including a hub rotatable about a rotational axis and a plurality of fan blades extending radially and axially from the hub and configured to produce an airflow when rotated about the rotational axis. Each blade has a dihedral distance and a chord length distribution both of which vary along the length of the blade as a function of blade radius from the rotational axis.

Further, the invention relates to a fan including a hub rotatable about a rotational axis and a plurality of fan blades extending radially and axially (or "dihedrally") from the hub and configured to produce an airflow when rotated about the rotational axis.

The invention also relates to a high efficiency, axial flow fan for producing an airflow through an engine compartment of a vehicle. The fan includes a hub rotatable about a rotational axis, a circular band concentric with the hub and spaced radially outward from the hub, and from two to twelve, and preferably from six to eight, and, most preferably, seven fan blades distributed circumferentially around the hub, evenly or unevenly spaced, and extending radially from the hub to the circular band. With the disclosed combination of geometric aspects, fans according to the present invention possess a high strength to weight ratio, and move air with great efficiency.

As is shown in FIGS. 3 and 4, C, the chord length, is the straight-line distance between the beginning and end of a circular arc camber line, and is measured at R, the radial distance from the axis of rotation. $\xi$ is the stagger angle of a blade section, that is, the angle in degrees between the axis of rotation and the chord line. $\Theta$ is the camber angle, that is, the angle in degrees of the leading edge tangent line and the trailing edge tangent line of a blade section at the radial distance R. $\Lambda$ is the skew angle of a blade chord section in degrees, measured with respect to a radius through the center of the fan at a blade hub root at the radial distance R, calculated at 30% chord, where the blade root position at the hub is defined as zero skew, and negative values of $d\Lambda/dR$ indicate a forward skew. h is the dihedral distance of the downstream edge of a blade (as shown in FIG. 2), at a radial distance R, from a datum plane perpendicular to the axis of rotation at the upstream surface of the hub, and is used to determine the slope, dh/dR, of the dihedral measured between two adjacent values of R. Of course, one of ordinary skill in the art will recognize that slope may be measured in other manners, for example, with respect to other datum planes.

Each blade has substantially the parameters defined by a particular set of values for R (the radial distance from the rotational axis), C (the chord length of the blade at the radial distance R), $\xi$ (the stagger angle in degrees of a blade section at the radial distance R), Θ (the camber angle in degrees of a blade section at the radial distance R), Λ (the skew angle of a blade chord section in degrees, at the radial distance R, calculated at 30% chord, where the blade root position at the hub is defined as zero skew, and negative values of dΛ/dR indicate a forward skew), h (the dihedral distance of the downstream edge of the blade, at the radial distance R, from a plane perpendicular to the axis of rotation at the upstream surface of the hub), and dh/dR (the slope of the dihedral measured between two adjacent values of R).

In addition, the invention relates to a vehicle cooling system including a heat exchanger, such as an engine coolant radiator or air conditioner heat exchanger, configured to transfer heat from a vehicle system, and a powered fan configured to move air through the heat exchanger. The fan includes fan blades which extend radially and axially and are configured to produce an airflow when rotated about a rotational axis.

In accordance with these aspects of the invention, a fan rotatable about a rotational axis is provided, the fan comprising a hub rotatable around the axis wherein the hub comprises an upstream surface and a circumferential surface, and a plurality of fan blades extending radially from the circumferential surface of the hub, the hub and blades being configured to produce an airflow when rotated about the axis, each blade having a chord length distribution, stagger angle and dihedral distance which varies along the length of the blade, each blade extending axially downstream from the upstream surface of the hub, wherein each blade joins a circular band concentric with the hub and spaced radially outward from the hub, the circular band comprising an upstream edge disposed substantially axially downstream from the upstream surface of the hub, and wherein the rate of change of the dihedral distance of the trailing edge of each blade with respect to a radius of each blade is substantially between −0.88 and +0.44. Furthermore, the fan preferably is configured so that the leading edge of each blade joins the circular band downstream from the upstream edge of the band.

A fan according to some aspects of the present invention preferably has from 2 to 12 blades, and the blades are spaced evenly around the circumferential portion of the hub in some embodiments of the invention and unevenly in others. In addition, the circular band of a fan according to the present invention has an L-shaped cross-section taken along a plane passing through the rotational axis. Also, a fan according to the present invention is provided preferably in combination with a duct, the circular band being operatively disposed within the duct such that, when the fan is rotated within the duct, an aeromechanical (labyrinth-type) seal is formed. In accordance with another aspect of the present invention, the hub, blades and circular band are an integral piece. By "integral," is meant that the fan blades, hub and circular band are formed or molded in one piece.

BRIEF DESCRIPTION OF THE DRAWINGS

The invention will become more fully understood from the following detailed description of the preferred embodiments thereof, taken in conjunction with the accompanying drawings, wherein like reference numerals refer to like parts, in which.

DETAILED DESCRIPTION OF THE PREFERRED EMBODIMENTS

The following is a detailed description of two specific embodiments and also includes ranges of parameters regarding a plurality of fans according to the present invention. FIGS. 1–4 show both specific embodiments of the fans as well as fans generally according to the invention. It should be understood that alternative embodiments, and particularly those which fall within the ranges of parameters disclosed, may be adapted or selected for use in various applications and are generally shown in FIGS. 1–4.

Figure 1:
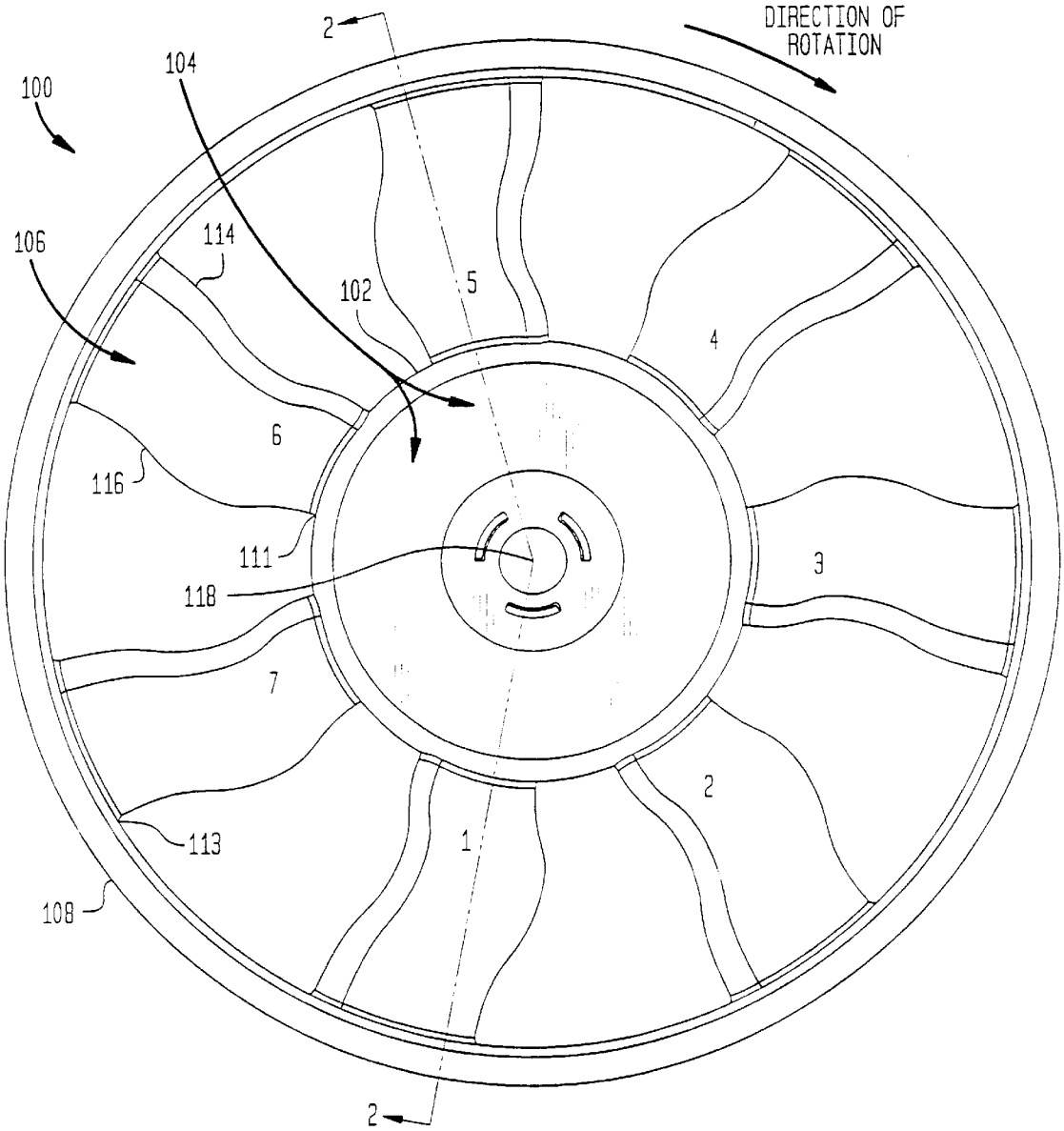
FIG. 1 is a front view of a first embodiment of a fan including a hub, fan blades and a circular band.
Figure 2:
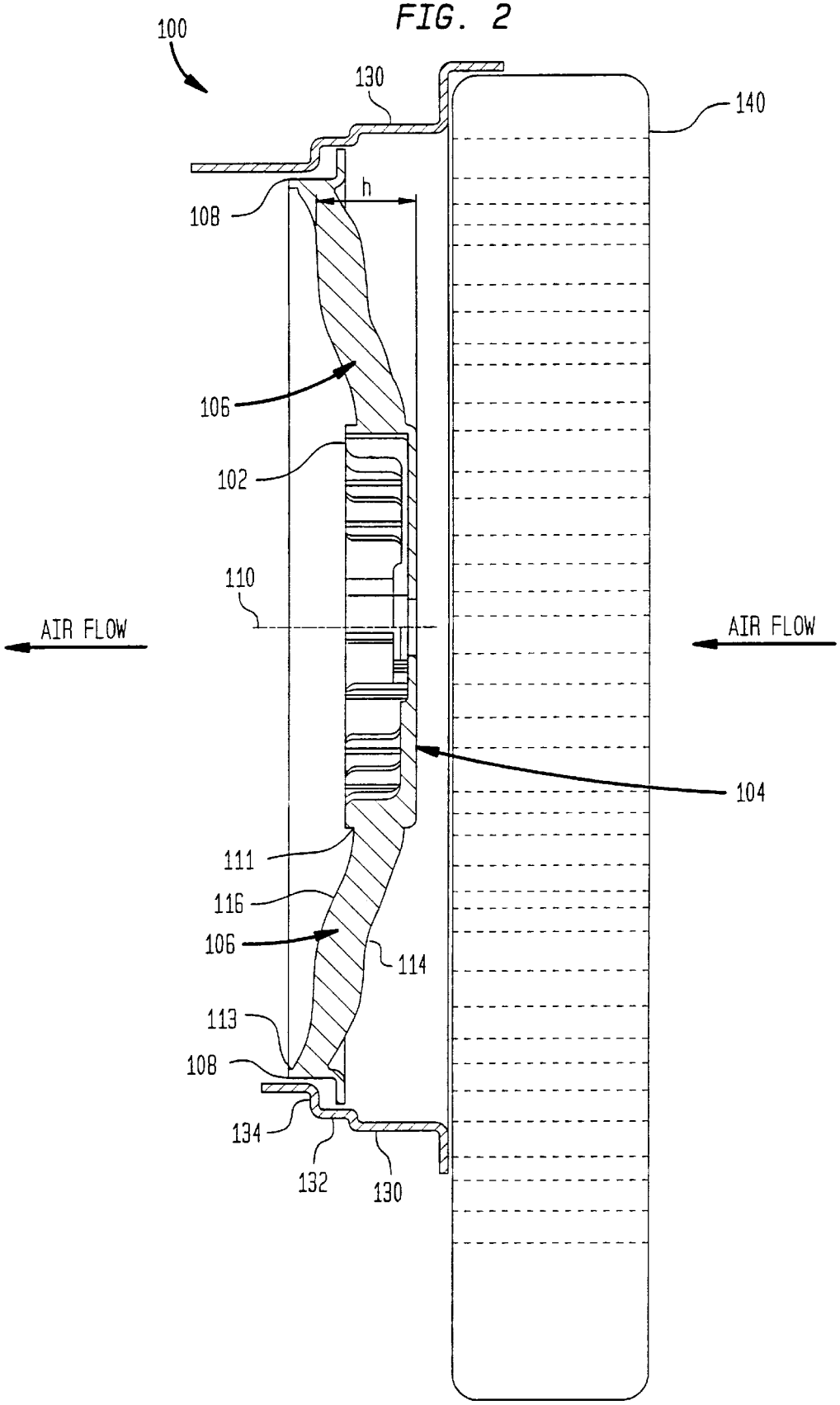
FIG. 2 is a side view of the fan in section shown in FIG. 1.
Figure 3:
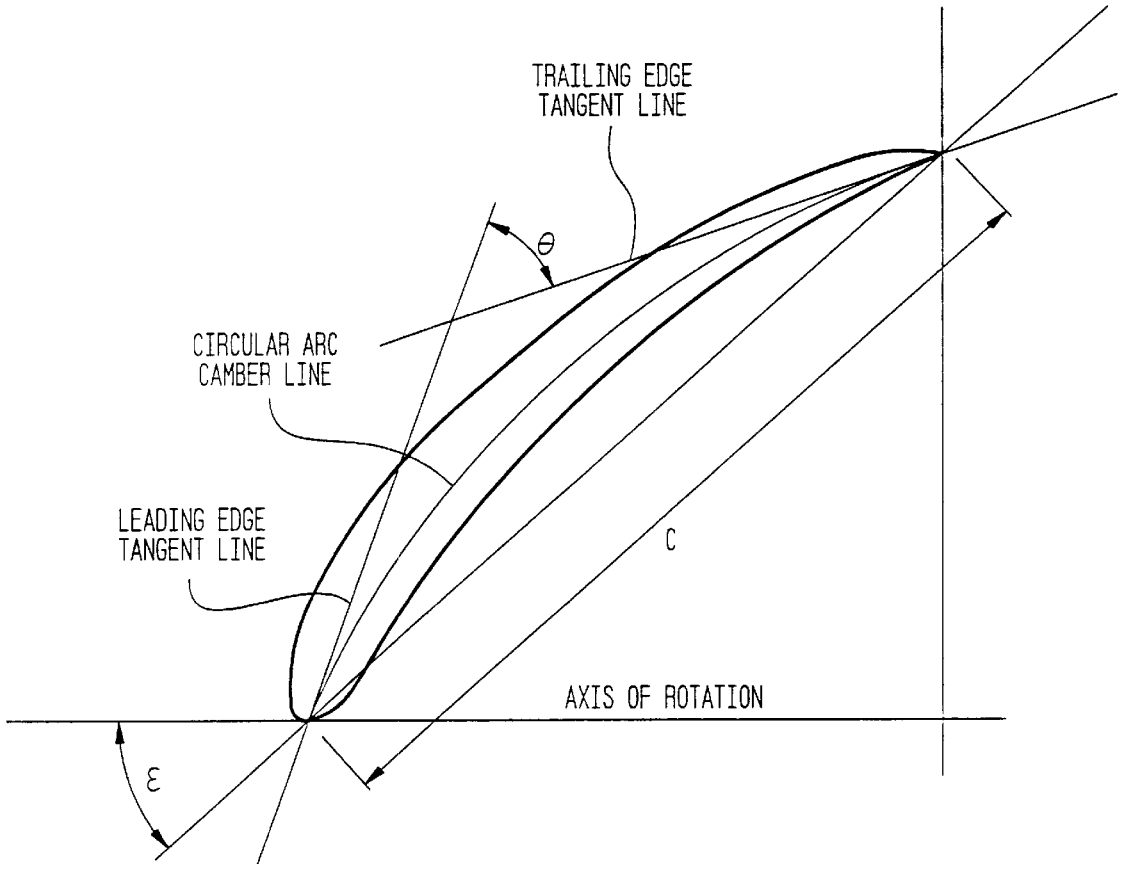
FIG. 3 depicts some of the relationships between and among several of the geometric parameters shown in FIGS. 1 and 2.
Figure 4:
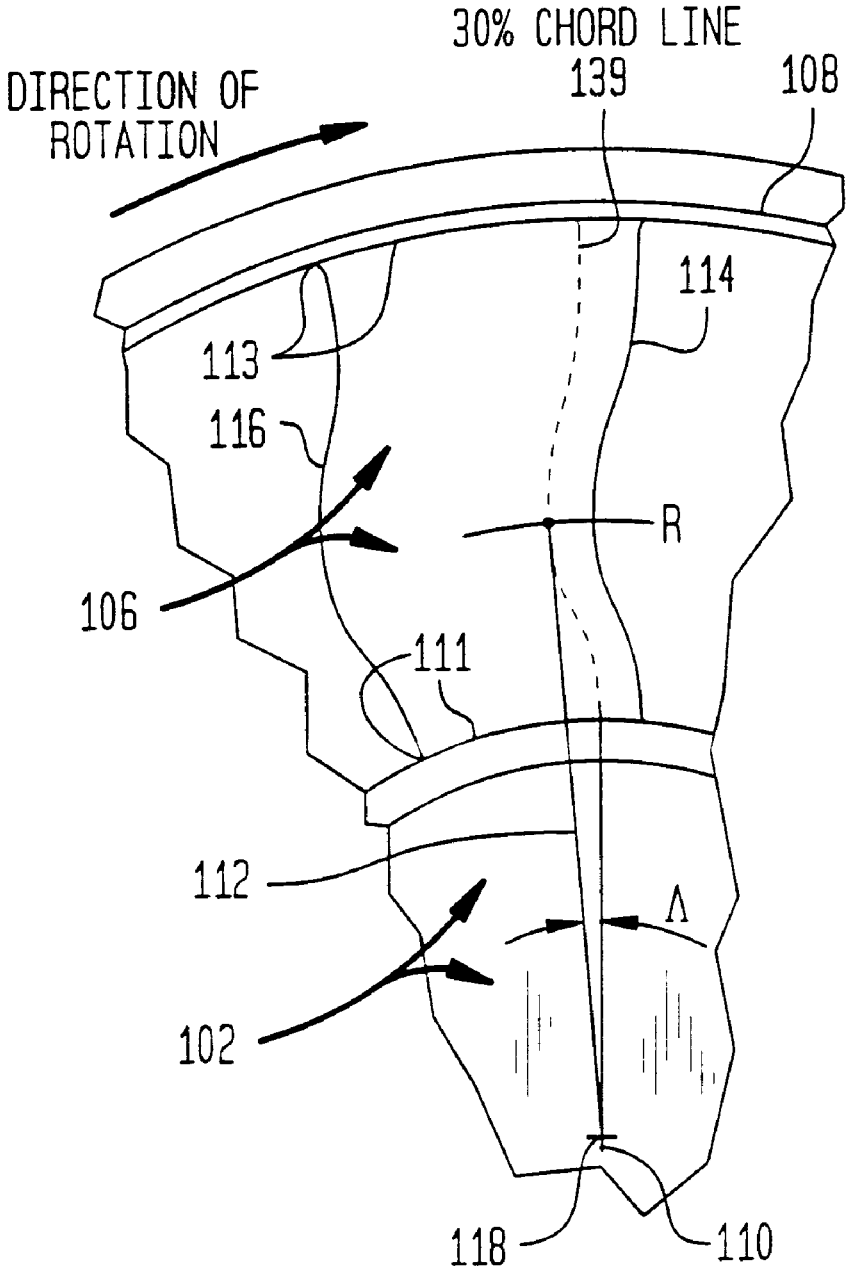
FIG. 4 depicts a portion of a fan and shows how skew is determined.

Specific embodiments of a fan 100 in accordance with the present invention are shown in FIGS. 1 through 4 where like numbers refer to like structures. FIG. 4 shows how the parameter blade skew is measured in all embodiments of the invention. Referring to FIGS. 1, 2 and 4, fan 100 is mounted in duct 130 which is attached, and preferably sealed, to heat exchanger 140. Fan 100 includes a circular hub 102, having an upstream surface 104, seven fan blades 106 and a circular band 108. Fan blades 106 each has blade root 111 connected to hub 102 and blade tip 113 connected to band 108. Hub 102 is concentric to a rotational axis 110 and has a radius 112 extending radially from rotational axis 110. Fan blades 106 are distributed circumferentially around hub 102, and are evenly spaced. In some embodiments according to the invention, the blades are spaced unevenly in order to obtained desired efficiencies and decreased noise levels. Blades 106 extend radially from hub 102 to band 108, with the distance between the two ends of blades 106 referred to as blade length. The distance between rotational axis 110 and locations along blades 106 is referred to as blade section radius R. As is shown in FIG. 1, blade section radii R are measured at various distances from axis 110, for example, at arcs B—B, C—C and D—D. Each blade 106 has leading edge 114, trailing edge 116, and a shape configured to produce an airflow when fan 100 is rotated about rotational axis 110.

An aspect of the invention pertains to the slope of trailing edge 116 of each blade 106 as each blade extends radially and dihedrally (axially) away from fan hub 102. This slope can be expressed relative to a datum plane perpendicular to rotational axis 110. As is shown in FIG. 2, the distance h of trailing edge 116 is measured from datum plane A—A which is perpendicular to rotational axis 110 through upstream surface 104 of hub 102. Values of h are measured at distances R to determine slope, or dh/dR. As one of skill in the art will recognize, slope can be measured by other methods also. FIG. 4 shows how the parameter blade skew is measured in all embodiments of the invention. Specifically, skew angle A of blade 106 is measured with respect to the center 118 of hub 102 and a chord line 139 30% from leading edge 114 of blade 106. Center 118 of hub 102 is concentric with axis of rotation 110.

In general, fan 100 is supported and securely coupled to a shaft (not shown) passing fully or partially through the center 118 in hub 102. Alternatively, the shaft may be securely coupled to fan 100 by other means, such as a screw passing through hub 102 along rotational axis 110 and into the shaft, or by a twist-lock fitting. The shaft is rotatably driven by a power source (not shown) such as an electric motor or vehicle engine. An appropriate gearing or transmission, such as a belt, chain or direct coupling drive, may couple the power source to the shaft. In the case of an electric motor, the output shaft of the motor may be used also as the shaft for the fan.

As the shaft is rotated about rotational axis 110 by the power source, torque is applied to hub 102, blades 106 and band 108, and fan 100 rotates about rotational axis 110. Upon rotation of fan 100, blades 106 generate an airflow generally in a direction shown by the arrows labeled "AIR FLOW" in FIG. 2. The airflow may serve to remove heat energy from a liquid, such as a coolant, flowing through heat exchanger 140. Fan 100 may be located on the upstream or downstream side of heat exchanger 140 to push or pull air through the heat exchanger depending upon the requirements of the particular configuration.

Referring to FIG. 2, band 108 is generally an L-shaped circumferential ring concentric with hub 102 and spaced radially outward from hub 102. Band 108 extends axially from hub 102, generally in a downstream direction. As is shown in FIG. 2, band 108 preferably cooperates with duct 130 to form an aeromechanical seal. Duct 130 includes a ring 132 and a circumferential flange 134 to reduce or eliminate undesirable airflow components, such as turbulence and recirculation, between fan 100 and duct 130. Band 108, ring 132 and circumferential flange 134 are concentric to each other when assembled, together forming an aeromechanical seal. However, preferably there is no physical contact between band 108 and duct 130.

A fan according to the invention may be mounted in close proximity to a heat exchanger by ways and methods known in the art. One of skill in the art will recognize the advisablilty of mounting the duct of the present invention to a heat exchanger in a sealed manner so that efficiencies are maximized. Similarly, a motor to which the fan is connected may be mounted in a vehicle engine compartment in ways known in the art.

The components of the invention may be constructed of commonly available materials. By way of example only, fan 100 may be an integrally molded piece fabricated from polycarbonate 20% G.F. Hydex 4320, or from mineral or glass reinforced polyaimide 6/6 (e.g., Du Pont Minlon 22C®), or from other composite or plastics known in the art, or from lightweight metals such as aluminum or titanium.

Table I below shows ranges of parameters for fan blades of first embodiments of the invention. Table II shows specific values which fall within the ranges of Table I, for a fan of the first embodiment of the present invention.

wherein R is the radial distance in meters from the rotational axis; C is the chord length in millimeters at the radial distance R; Θ is the blade section camber angle in degrees at the radial distance R; ξ is the blade section stagger angle in degrees at the radial distance R; Λ is the skew angle of the chord section in degrees, at the radial distance R, calculated at 30% chord; h is the dihedral distance in millimeters of the downstream edge of the blade, at the radial distance R, from a datum plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

TABLE II

SPECIFIC BLADE DIMENSIONS

| R (m) | C (mm) | Θ (deg) | ξ (deg) | Λ (deg) | Range of R over which dh/dR is measured (mm) | h (mm) | dh/dR (mm/mm) |
|---|---|---|---|---|---|---|---|
| 0.075 | 45.38 | 30.00 | 66.55 | 0.0 | 75.00 to 85.00 | −23.96 | −0.070 |
| 0.085 | 47.28 | 25.00 | 68.22 | 2.0 | 85.00 to 95.00 | −24.66 | −0.330 |
| 0.095 | 47.85 | 23.00 | 70.13 | 5.0 | 95.00 to 105.00 | −27.96 | −0.410 |
| 0.105 | 48.28 | 23.00 | 69.29 | 6.0 | 105.00 to 115.00 | −32.06 | −0.390 |
| 0.115 | 48.51 | 23.00 | 69.25 | 6.0 | 115.00 to 125.00 | −35.96 | −0.200 |
| 0.125 | 49.08 | 23.50 | 69.71 | 5.0 | 125.00 to 135.00 | −37.96 | −0.050 |
| 0.135 | 50.32 | 23.50 | 70.80 | 3.0 | 135.00 to 145.00 | −38.46 | −0.050 |
| 0.145 | 51.20 | 23.00 | 73.01 | −0.2 | 145.00 to 155.00 | −38.96 | −0.200 |
| 0.155 | 54.18 | 20.00 | 77.50 | 0.9 | 155.00 to 162.00 | −40.96 | −0.507 |
| 0.162 | 56.65 | 18.50 | 79.00 | 0.3 | 162.00 to 167.00 | −44.51 | −0.578 |
| 0.167 | 59.40 | 19.00 | 79.00 | −0.2 | — | −47.40 | — |

wherein R is the radial distance in meters from the rotational axis; C is the chord length in millimeters at the radial distance R; Θ is the blade section camber angle in degrees at the radial distance R; ξ is the blade section stagger angle in degrees at the radial distance R; Λ is the skew angle of the chord section in degrees, at the radial distance R, calculated at 30% chord; h is the dihedral distance in millimeters of the downstream edge of the blade, at the radial distance R, from a plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

TABLE I

RANGES OF DIMENSIONS

| R (mm) | C (mm) | Θ (deg) | ξ (deg) | Λ (deg) | Range of R over which dh/dR is measured (mm) | dh/dR (mm/mm) |
|---|---|---|---|---|---|---|
| 0.075 | | 25.0 to 40.0 | 61.55 to 71.55 | −3.0 to +3.0 | 75.00 to 85.00 | −0.37 to +0.23 |
| 0.085 | | 20.0 to 35.0 | 63.22 to 73.22 | −1.0 to +5.0 | 85.00 to 95.00 | −0.66 to −0.03 |
| 0.095 | | 18.0 to 33.0 | 65.13 to 75.13 | +2.0 to +8.0 | 95.00 to 105.00 | −0.71 to −0.11 |
| 0.105 | | 18.0 to 33.0 | 64.29 to 74.29 | +3.0 to 9.0 | 105.00 to 115.00 | −0.69 to −0.09 |
| 0.115 | | 18.0 to 33.0 | 64.25 to 74.25 | +3.0 to +9.0 | 115.00 to 125.00 | −0.50 to +0.10 |
| 0.125 | | 18.5 to 33.5 | 64.71 to 74.71 | +2.0 to 8.0 | 125.00 to 135.00 | −0.35 to +0.25 |
| 0.135 | 10.06 to 57.87 | 18.5 to 33.5 | 65.80 to 75.80 | 0.0 to +6.0 | 135.00 to 145.00 | −0.35 to +0.25 |
| 0.145 | 10.24 to 59.38 | 18.0 to 33.0 | 68.01 to 78.01 | −3.2 to +2.8 | 145.00 to 155.00 | −0.50 to +0.10 |
| 0.155 | 10.84 to 62.31 | 15.0 to 30.0 | 72.50 to 82.50 | −2.1 to +3.9 | 155.00 to 162.00 | −0.80 to −0.21 |
| 0.162 | 11.33 to 65.15 | 13.5 to 28.5 | 74.00 to 84.00 | −2.7 to +3.3 | 162.00 to 167.00 | −0.88 to +0.28 |
| 0.167 | 11.88 to 68.31 | 14.5 to 29.0 | 74.00 to 84.00 | −3.2 to +2.8 | — | — |

It is known that any fan design can be scaled in size. It can be appreciated that certain parameters in TABLE II can be non-dimensionalized by the span dimension, the distance from the blade tip 113 to the blade root 111. In the fan embodiment defined in TABLE II the span is 92 mm. TABLE II(i) below shows the non-dimensionalized parameters of % span, chord (C)/span, dihedral (h)/span of the fan embodiment of TABLE II.

TABLE II(i)

SPECIFIC BLADE DIMENSIONS

| R (mm) | % span | C (mm) | C/span | Θ (deg) | ξ (deg) | Λ (deg) | h (mm) | h/span | Range of R over which dh/dR) is measured (%) | dh/dR |
|---|---|---|---|---|---|---|---|---|---|---|
| 0.075 | 0.00 | 45.38 | 0.4933 | 30.00 | 66.55 | 0.0 | −23.96 | −0.2604 | 0 to 10.87 | −0.070 |
| 0.085 | 10.87 | 47.28 | 0.5139 | 25.00 | 68.22 | 2.0 | −24.66 | −0.2680 | 10.87 to 21.74 | 0.330 |
| 0.095 | 21.74 | 47.85 | 0.5201 | 23.00 | 70.13 | 5.0 | −27.96 | −0.3039 | 21.74 to 32.61 | −0.410 |
| 0.105 | 32.61 | 48.28 | 0.5248 | 23.00 | 69.29 | 6.0 | −32.06 | −0.3485 | 32.61 to 43.48 | −0.390 |
| 0.115 | 43.48 | 48.51 | 0.5273 | 23.00 | 69.25 | 6.0 | −35.96 | −0.3909 | 43.48 to 54.35 | −0.200 |
| 0.125 | 54.35 | 49.08 | 0.5335 | 23.50 | 69.71 | 5.0 | −37.96 | −0.4126 | 54.35 to 65.22 | −0.050 |
| 0.135 | 65.22 | 50.32 | 0.5470 | 23.50 | 70.80 | 3.0 | −38.46 | −0.4180 | 65.22 to 76.09 | −0.050 |
| 0.145 | 76.09 | 51.20 | 0.5565 | 23.00 | 73.01 | −0.2 | −38.96 | −0.4235 | 76.09 to 86.96 | −0.200 |
| 0.155 | 86.96 | 54.18 | 0.5889 | 20.00 | 77.50 | 0.9 | −40.96 | −0.4452 | 86.96 to 94.57 | −0.507 |
| 0.162 | 94.57 | 56.65 | 0.6158 | 18.50 | 79.00 | 0.3 | −44.51 | −0.4838 | 94.57 to 100 | −0.578 |
| 0.167 | 100 | 59.40 | 0.6457 | 19.00 | 79.00 | −0.2 | −47.40 | −0.5152 | — | — |

wherein R is the radial distance in meters from the rotational axis; C is the chord length in millimeters at the radial distance R; Θ is the blade section camber angle in degrees at the radial distance R; ξ is the blade section stagger angle in degrees at the radial distance R; Λ is the skew angle of the chord section in degrees, at the radial distance R, calculated at 30% chord; h is the dihedral distance in millimeters of the downstream edge of the blade, at the radial distance R, from a datum plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

Table III below shows ranges of parameters for fan blades of second embodiments of the invention. Table IV shows specific values which fall within the ranges of Table III, for a fan of a second embodiment of the present invention. Because they are similar in conformation, fans according to the invention shown in Tables I–IV are depicted in FIGS. 1.

wherein R is the radial distance in meters from the rotational axis; C is the chord length in millimeters at the radial distance R; Θ is the blade section camber angle in degrees at the radial distance R; ξ is the blade section stagger angle in degrees at the radial distance R; Λ is the skew angle of the chord section in degrees, at the radial distance R, calculated at 30% chord; h is the dihedral distance in millimeters of the downstream edge of the blade, at the radial distance R, from a plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

Aspects of the shape of blades 106 described by the ranges of parameters in Table I, and for the fan embodiments characterized by the parameters of Tables II, III and IV described below, including the slope of trailing edge 116, are optimized to provide high efficiency, high strength to weight ratio, and low weight. In particular, each blade 106 of an embodiment of the present invention has the following parameters:

TABLE III

RANGES OF DIMENSIONS

| R (mm) | C (mm) | Θ (deg) | ξ (deg) | Λ (deg) | h (mm) | Range of R over which dh/dR) is measured (mm) | dh/dR (mm/mm) |
|---|---|---|---|---|---|---|---|
| 0.075 | 9.08 to 52.19 | 25.0 to 40.0 | 58.73 to 68.73 | −3.0 to 3.0 | −41.71 | 75.00 to 85.00 | −0.690 to −.090 |
| 0.085 | 9.39 to 53.97 | 20.0 to 35.0 | 61.14 to 71.14 | −1.0 to 5.0 | −45.61 | 85.00 to 95.00 | −0.676 to −.076 |
| 0.095 | 9.58 to 55.06 | 18.0 to 33.0 | 60.65 to 70.65 | 1.78 to 7.78 | −49.37 | 95.00 to 105.00 | −0.417 to +.183 |
| 0.105 | 9.66 to 55.57 | 18.0 to 33.0 | 60.66 to 70.66 | 3.0 to 9.0 | −50.54 | 105.00 to 115.00 | −0.270 to +.330 |
| 0.115 | 9.71 to 55.82 | 18.0 to 33.0 | 61.17 to 71.17 | 3.0 to 9.0 | −50.24 | 115.00 to 125.00 | −0.234 to +.366 |
| 0.125 | 9.78 to 56.22 | 18.5 to 33.5 | 62.19 to 72.19 | 2.12 to 8.12 | −49.58 | 125.00 to 135.00 | −0.208 to +.392 |
| 0.135 | 9.94 to 57.14 | 18.5 to 33.5 | 63.71 to 73.71 | .72 to 6.72 | −48.66 | 135.00 to 145.00 | −0.187 to +.413 |
| 0.145 | 10.25 to 58.93 | 18.0 to 33.0 | 65.74 to 75.74 | −0.82 to 5.18 | 47.53 | 145.00 to 155.00 | −0.160 to +.440 |
| 0.155 | 10.77 to 61.95 | 18.0 to 33.0 | 68.27 to 78.27 | −2.1 to 3.9 | −46.13 | 155.00 to 162.00 | −0.271 to +.329 |
| 0.162 | 11.32 to 65.13 | 19.5 to 34.5 | 70.34 to 80.34 | −2.62 to 3.38 | −45.93 | 162.00 to 167.00 | −0.518 to +.082 |
| 0.167 | 11.88 to 68.31 | 21.0 to 36.0 | 71.97 to 81.97 | −3.2 to 2.8 | −47.02 | — | — |

TABLE IV

SPECIFIC BLADE DIMENSIONS

| R (mm) | C (mm) | Θ (deg) | ξ (deg) | Λ (deg) | h (mm) | Range of R over which dh/dR is measured (mm) | dh/dR (mm/mm) |
|---|---|---|---|---|---|---|---|
| 0.075 | 45.38 | 30.00 | 63.73 | 0.00 | −41.71 | 75.00 to 85.00 | −.390 |
| 0.085 | 46.93 | 25.00 | 66.14 | 2.00 | −45.61 | 85.00 to 95.00 | −.376 |
| 0.095 | 47.88 | 23.00 | 65.65 | 4.78 | −49.37 | 95.00 to 105.00 | −.117 |
| 0.105 | 48.32 | 23.00 | 65.66 | 6.00 | −50.54 | 105.00 to 115.00 | +.030 |
| 0.115 | 48.54 | 23.00 | 66.17 | 6.00 | −50.24 | 115.00 to 125.00 | +.066 |
| 0.125 | 48.89 | 23.50 | 67.19 | 5.12 | −49.58 | 125.00 to 135.00 | +.092 |
| 0.135 | 49.69 | 23.50 | 68.71 | 3.72 | −48.66 | 135.00 to 145.00 | +.113 |
| 0.145 | 51.24 | 23.00 | 70.74 | 2.18 | −47.53 | 145.00 to 155.00 | +.140 |
| 0.155 | 53.87 | 23.00 | 73.27 | 0.9 | −46.13 | 155.00 to 162.00 | +.029 |
| 0.162 | 56.62 | 24.50 | 75.34 | 0.38 | −45.93 | 162.00 to 167.00 | −.218 |
| 0.167 | 59.40 | 26.00 | 76.97 | −0.20 | −47.02 | — | — |

wherein R is the radial distance in meters from the rotational axis; C is the chord length in millimeters at the radial distance R; Θ is the blade section camber angle in degrees at the radial distance R; ξ is the blade section stagger angle in degrees at the radial distance R; Λ is the skew angle of the chord section in degrees, at the radial distance R, calculated at 30% chord; h is the dihedral distance in millimeters of the downstream edge of the blade, at the radial distance R, from a datum plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

It can be appreciated that certain parameters in TABLE IV can be non-dimensionalized by the span dimension, the distance from the blade tip 113 to the blade root 111. In the fan embodiment defined in TABLE IV, the span is 92 mm. TABLE IV(i) below shows the non-dimensionalized parameters of % span, chord (C)/span, dihedral (h)/span of the fan embodiment of TABLE IV.

TABLE IV(I)

SPECIFIC BLADE DIMENSIONS

| R (m) | % span | C (mm) | C/span | Θ (deg) | ξ (deg) | Λ (deg) | h (mm) | h/span | Range of R over which dh/dR is measured (%) | dh/dR (mm/mm) |
|---|---|---|---|---|---|---|---|---|---|---|
| 0.075 | 0.00 | 45.38 | 0.4933 | 30.00 | 63.73 | 0.00 | −41.71 | −0.4534 | 0 to 10.87 | −0.390 |
| 0.085 | 10.87 | 46.93 | 0.5101 | 25.00 | 66.14 | 2.00 | −45.61 | −0.4958 | 10.87 to 21.74 | −0.376 |
| 0.095 | 21.74 | 47.88 | 0.5204 | 23.00 | 65.65 | 4.78 | −49.37 | −0.5366 | 21.74 to 32.61 | −0.117 |
| 0.105 | 32.61 | 48.32 | 0.5252 | 23.00 | 65.66 | 6.00 | −50.54 | −0.5493 | 32.61 to 43.48 | 0.030 |
| 0.115 | 43.48 | 48.54 | 0.5276 | 23.00 | 66.17 | 6.00 | −50.24 | −0.5461 | 43.48 to 54.35 | 0.066 |
| 0.125 | 54.35 | 48.89 | 0.5314 | 23.50 | 67.19 | 5.12 | −49.58 | −0.5389 | 54.35 to 65.22 | 0.092 |
| 0.135 | 65.22 | 49.69 | 0.5401 | 23.50 | 68.71 | 3.72 | −48.66 | −0.5289 | 65.22 to 76.09 | 0.113 |
| 0.145 | 76.09 | 51.24 | 0.5570 | 23.00 | 70.74 | 2.18 | −47.53 | −0.5166 | 76.09 to 86.96 | 0.140 |
| 0.155 | 86.96 | 53.87 | 0.5855 | 23.00 | 73.27 | 0.90 | −46.13 | −0.5014 | 86.96 to 94.57 | 0.029 |
| 0.162 | 94.57 | 56.62 | 0.6154 | 24.50 | 75.34 | 0.38 | −45.93 | −0.4992 | 94.57 to 100 | −0.218 |
| 0.167 | 100 | 59.40 | 0.6457 | 26.00 | 76.97 | −0.20 | −47.02 | −0.5111 | — | — |

wherein R is the radial distance in meters from the rotational axis; C is the chord length in millimeters at the radial distance R; Θ is the blade section camber angle in degrees at the radial distance R; ξ is the blade section 10 stagger angle in degrees at the radial distance R; Λ is the skew angle of the chord section in degrees, at the radial distance R, calculated at 30% chord; h is the dihedral distance in millimeters of the downstream edge of the blade, at the radial distance R, from a datum plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

While the embodiments illustrated in the FIGURES and described above are presently preferred, it should be understood that these embodiments are offered by way of example only. For instance, other embodiments may have a different number of fan blades, or may have different parameter values than those listed for the two specific fan embodiments and numerous other fans described herein. Moreover, the accuracy of the parameter values in Tables I, II, III and IV is not intended to limit the scope of the invention. The invention is not intended to be limited to any particular embodiment, but is intended to extend to various modifications that nevertheless fall within the spirit and scope of the following claims.

While the invention has been described in connection with what is presently considered to be the most practical and preferred embodiment, it is understood that the invention is not limited to the disclosed embodiments but, on the contrary, is intended to cover various modifications and equivalent arrangements included within the spirit and scope of the appended claims.

What is claimed is:

1. A fan rotatable about a rotational axis comprising:

a hub rotatable around the axis wherein the hub comprises an upstream surface and a circumferential surface, and a plurality of fan blades extending radially from the circumferential surface of the hub, the hub and blades being configured to produce an airflow when rotated about the axis, each blade having a chord length distribution, stagger angle and dihedral distance which varies along the length of the blade, each blade extending axially downstream from the upstream surface of the hub, wherein each blade joins a circular band concentric with the hub and spaced radially outward from the hub, the circular band comprising an upstream edge disposed substantially axially downstream from the upstream surface of the hub, and wherein the rate of change of the dihedral distance of a trailing edge of each blade with respect to a radius of each blade is substantially between −0.88 and +0.44.

2. The fan of claim 1, wherein a leading edge of each blade joins the circular band downstream from the upstream edge of the band.

3. The fan of claim 2, wherein the leading edge of each blade joins the circular band downstream from the upstream edge of the band at a distance of from 2.0 to 6.0 millimeters.

4. The fan of claim 1, wherein there are seven blades spaced evenly around the circumferential portion of the hub.

5. The fan of claim 2, wherein the circular band has a generally L-shaped cross-section taken along a plane passing through the rotational axis.

6. The fan of claim 5, in combination with a duct, the circular band being operatively disposed within the duct such that, when the fan is rotated within the duct, an aeromechanical seal is formed.

7. The fan of claim 6, wherein the hub, blades and circular band are an integral piece.

8. A high efficiency axial flow fan for producing an airflow through an engine compartment of a vehicle comprising:

a hub rotatable about a rotational axis, a circular band concentric with the hub and spaced radially outward from the hub, and a plurality of fan blades distributed circumferentially around the hub and extending radially from the hub to the circular band, wherein each blade has substantially the parameters defined by

| R (mm) | C (mm) | Θ (deg) | ξ (deg) | Λ (deg) | Range of R over which dh/dR is measured (mm) | dh/dR (mm/mm) |
|---|---|---|---|---|---|---|
| 0.075 | | 25.0 to 40.0 | 61.55 to 71.55 | −3.0 to +3.0 | 75.00 to 85.00 | −0.37 to +0.23 |
| 0.085 | | 20.0 to 35.0 | 63.22 to 73.22 | −1.0 to +5.0 | 85.00 to 95.00 | −0.66 to −0.03 |
| 0.095 | | 18.0 to 33.0 | 65.13 to 75.13 | +2.0 to +8.0 | 95.00 to 105.00 | −0.71 to −0.11 |
| 0.105 | | 18.0 to 33.0 | 64.29 to 74.29 | +3.0 to 9.0 | 105.00 to 115.00 | −0.69 to −0.09 |
| 0.115 | | 18.0 to 33.0 | 64.25 to 74.25 | +3.0 to +9.0 | 115.00 to 125.00 | −0.50 to +0.10 |
| 0.125 | | 18.5 to 33.5 | 64.71 to 74.71 | +2.0 to 8.0 | 125.00 to 135.00 | −0.35 to +0.25 |
| 0.135 | 10.06 to 57.87 | 18.5 to 33.5 | 65.80 to 75.80 | 0.0 to +6.0 | 135.00 to 145.00 | −0.35 to +0.25 |
| 0.145 | 10.24 to 59.38 | 18.0 to 33.0 | 68.01 to 78.01 | −3.2 to +2.8 | 145.00 to 155.00 | −0.50 to +0.10 |
| 0.155 | 10.84 to 62.31 | 15.0 to 30.0 | 72.50 to 82.50 | −2.1 to +3.9 | 155.00 to 162.00 | −0.80 to −0.21 |
| 0.162 | 11.33 to 65.15 | 13.5 to 28.5 | 74.00 to 84.00 | −2.7 to +3.3 | 162.00 to 167.00 | −0.88 to +0.28 |
| 0.167 | 11.88 to 68.31 | 14.5 to 29.0 | 74.00 to 84.00 | −3.2 to +2.8 | — | — |

wherein R is the radial distance in meters from the rotational axis; C is the chord length in millimeters at the radial distance R; Θ is the blade section camber angle in degrees at the radial distance R; ξ is the blade section stagger angle in degrees at the radial distance R; Λ is the skew angle of the chord section in degrees, at the radial distance R, calculated at 30% chord; h is the dihedral distance in millimeters of the downstream edge of the blade, at the radial distance R, from a plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

9. The fan of claim 8, wherein the circular band has an L-shaped cross-section taken along a plane passing through the rotational axis.

10. The fan of claim 8, wherein there are seven blades spaced evenly around a circumferential portion of the hub.

11. The fan of claim 8, in combination with a duct, the circular band being operatively disposed within the duct such that, when the fan is rotated within the duct, an aeromechanical seal is formed.

12. The fan of claim 8, wherein the hub, blades and circular band are made integral.

13. A high efficiency axial flow fan for producing an airflow through an engine compartment of a vehicle comprising:

a hub rotatable about a rotational axis, a circular band concentric with the hub and spaced radially outward from the hub, and a plurality of fan blades distributed circumferentially around the hub and extending radially from the hub to the circular band, wherein each blade has substantially the parameters defined by

| R (m) | C (mm) | Θ (deg) | ξ (deg) | Λ (deg) | Range of R over which dh/dR is measured (mm) | h (mm) | dh/dR (mm/mm) |
|---|---|---|---|---|---|---|---|
| 0.075 | 45.38 | 30.00 | 66.55 | 0.0 | 75.00 to 85.00 | −23.96 | −0.070 |
| 0.085 | 47.28 | 25.00 | 68.22 | 2.0 | 85.00 to 95.00 | −24.66 | −0.330 |
| 0.095 | 47.85 | 23.00 | 70.13 | 5.0 | 95.00 to 105.00 | −27.96 | −0.410 |
| 0.105 | 48.28 | 23.00 | 69.29 | 6.0 | 105.00 to 115.00 | −32.06 | −0.390 |

-continued

| R (m) | C (mm) | Θ (deg) | ξ (deg) | Λ (deg) | Range of R over which dh/dR is measured (mm) | h (mm) | dh/dR (mm/mm) |
|---|---|---|---|---|---|---|---|
| 0.115 | 48.51 | 23.00 | 69.25 | 6.0 | 115.00 to 125.00 | −35.96 | −0.200 |
| 0.125 | 49.08 | 23.50 | 69.71 | 5.0 | 125.00 to 135.00 | −37.96 | −0.050 |
| 0.135 | 50.32 | 23.50 | 70.80 | 3.0 | 135.00 to 145.00 | −38.46 | −0.050 |
| 0.145 | 51.20 | 23.00 | 73.01 | −0.2 | 145.00 to 155.00 | −38.96 | −0.200 |
| 0.155 | 54.18 | 20.00 | 77.50 | 0.9 | 155.00 to 162.00 | −40.96 | −0.507 |
| 0.162 | 56.65 | 18.50 | 79.00 | 0.3 | 162.00 to 167.00 | −44.51 | −0.578 |
| 0.167 | 59.40 | 19.00 | 79.00 | −0.2 | — | −47.40 | — |

wherein R is the radial distance in meters from the rotational axis; C is the chord length in millimeters at the radial distance R; Θ is the blade section camber angle in degrees at the radial distance R; ξ is the blade section stagger angle in degrees at the radial distance R;

Λ is the skew angle of the chord section in degrees, at the radial distance R, calculated at 30% chord; h is the dihedral distance in millimeters of the downstream edge of the blade, at the radial distance R, from a plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

14. A high efficiency axial flow fan for producing an airflow through an engine compartment of a vehicle comprising:

a hub rotatable about a rotational axis, a circular band concentric with the hub and spaced radially outward from the hub, and a plurality of fan blades distributed circumferentially around the hub and extending radially from the hub to the circular band, wherein each blade has substantially the parameters defined by

| R (mm) | C (mm) | Θ (deg) | ξ (deg) | Λ (deg) | h (mm) | dh/dR (mm/mm) |
|---|---|---|---|---|---|---|
| 0.075 | 45.38 | 30.00 | 63.73 | 0.00 | −41.71 | −0.390 |
| 0.085 | 46.93 | 25.00 | 66.14 | 2.00 | −45.61 | −0.376 |
| 0.095 | 47.88 | 23.00 | 65.65 | 4.78 | −49.37 | −0.117 |
| 0.105 | 48.32 | 23.00 | 65.66 | 6.00 | −50.54 | +0.030 |
| 0.115 | 48.54 | 23.00 | 66.17 | 6.00 | −50.24 | +0.066 |
| 0.125 | 48.89 | 23.50 | 67.19 | 5.12 | −49.58 | +0.092 |
| 0.135 | 49.69 | 23.50 | 68.71 | 3.72 | −48.66 | +0.113 |
| 0.145 | 51.24 | 23.00 | 70.74 | 2.18 | −47.53 | +0.140 |
| 0.155 | 53.87 | 23.00 | 73.27 | 0.9 | −46.13 | +0.029 |
| 0.162 | 56.62 | 24.50 | 75.34 | 0.38 | −45.93 | −0.218 |
| 0.167 | 59.40 | 26.00 | 76.97 | −0.20 | −47.02 | — |

wherein R is the radial distance in meters from the rotational axis; C is the chord length in millimeters at the radial distance R; ξ is the blade section stagger angle in degrees at the radial distance R; Θ is the blade section camber angle in degrees at the radial distance R; h is the dihedral distance in millimeters of the downstream edge of the blade, at the radial distance R, from a plane perpendicular to the axis of rotation at the upstream surface of the hub; and Λ is the skew angle of the chord section in degrees, at the radial distance R, calculated at 30% chord; where the blade root position at the hub is defined as zero skew, and negative values of dΛ/dR indicate a forward skew.

15. A high efficiency axial flow fan for producing an airflow through an engine compartment of a vehicle comprising:

a hub rotatable about a rotational axis, a circular band concentric with the hub and spaced radially outward from the hub, and a plurality of fan blades distributed circumferentially around the hub and extending radially from a blade root at the hub to a blade tip at the circular band, wherein each blade has substantially the parameters defined by

| % span | C/span | Θ (deg) | ξ (deg) | Λ (deg) | h/span |
|---|---|---|---|---|---|
| 0.00 | 0.4933 | 30.00 | 63.73 | 0.00 | −0.4534 |
| 10.87 | 0.5101 | 25.00 | 66.14 | 2.00 | −0.4958 |
| 21.74 | 0.5204 | 23.00 | 65.65 | 4.78 | −0.5366 |
| 32.61 | 0.5252 | 23.00 | 65.66 | 6.00 | −0.5493 |
| 43.48 | 0.5276 | 23.00 | 66.17 | 6.00 | −0.5461 |
| 54.35 | 0.5314 | 23.50 | 67.19 | 5.12 | −0.5389 |
| 65.22 | 0.5401 | 23.50 | 68.71 | 3.72 | −0.5289 |
| 76.09 | 0.5570 | 23.00 | 70.74 | 2.18 | −0.5166 |
| 86.96 | 0.5855 | 23.00 | 73.27 | 0.90 | −0.5014 |
| 94.57 | 0.6154 | 24.50 | 75.34 | 0.38 | −0.4992 |
| 100 | 0.6457 | 26.00 | 76.97 | −0.20 | −0.5111 |

wherein span is a distance from a blade tip to a blade root, C is the chord length at a % span; ξ is the blade section stagger angle in degrees at a % span; Θ is the blade section camber angle in degrees at a % span; h is the dihedral distance of a downstream edge of a blade, at a % span, from a plane perpendicular to an axis of rotation at an upstream surface of the hub; and Λ is the skew angle of the chord section in degrees, at a % span, calculated at 30% chord.

16. The fan of claim 15, wherein the circular band has a generally L-shaped cross-section taken along a plane passing through the rotational axis.

17. The fan of claim 15, wherein there are seven blades spaced evenly around a circumferential portion of the hub.

18. The fan of claim 15, in combination with a duct, the circular band being operatively disposed within the duct such that, when the fan is rotated within the duct, an aeromechanical seal is formed.

19. The fan of claim 15, wherein the hub, blades and circular band are made integral.

20. A high efficiency axial flow fan for producing an airflow through an engine compartment of a vehicle comprising:

a hub rotatable about a rotational axis, a circular band concentric with the hub and spaced radially outward from the hub, and a plurality of fan blades distributed circumferentially around the hub and extending radially from a blade root at the hub to a blade tip at the circular band, wherein each blade has substantially the parameters defined by

| % span | C/span | Θ (deg) | ξ (deg) | Λ (deg) | h/span |
|---|---|---|---|---|---|
| 0.00 | 0.4933 | 30.00 | 66.55 | 0.0 | −0.2604 |
| 10.87 | 0.5139 | 25.00 | 68.22 | 2.0 | −0.2680 |
| 21.74 | 0.5201 | 23.00 | 70.13 | 5.0 | −0.3039 |
| 32.61 | 0.5248 | 23.00 | 69.29 | 6.0 | −0.3485 |
| 43.48 | 0.5273 | 23.00 | 69.25 | 6.0 | −0.3909 |
| 54.35 | 0.5335 | 23.50 | 69.71 | 5.0 | −0.4126 |
| 65.22 | 0.5470 | 23.50 | 70.80 | 3.0 | −0.4180 |
| 76.09 | 0.5565 | 23.00 | 73.01 | −0.2 | −0.4235 |
| 86.96 | 0.5889 | 20.00 | 77.50 | 0.9 | −0.4452 |
| 94.57 | 0.6158 | 18.50 | 79.00 | 0.3 | −0.4838 |
| 100 | 0.6457 | 19.00 | 79.00 | −0.2 | −0.5152 |

wherein span is a distance from a blade tip to a blade root, C is the chord length at a % span; ξ is the blade section stagger angle in degrees at a % span; Θ is the blade section camber angle in degrees at a % span; h is the dihedral distance of a downstream edge of a blade, at a % span, from a plane perpendicular to an axis of rotation at an upstream surface of the hub; and Λ is the skew angle of the chord section in degrees, at a % span, calculated at 30% chord.

21. The fan of claim 20, wherein the circular band has a generally L-shaped cross-section taken along a plane passing through the rotational axis.

22. The fan of claim 20, wherein there are seven blades spaced evenly around a circumferential portion of the hub.

23. The fan of claim 20, in combination with a duct, the circular band being operatively disposed within the duct such that, when the fan is rotated within the duct, an aeromechanical seal is formed.

24. The fan of claim 20, wherein the hub, blades and circular band are made integral.

25. A vehicle cooling system comprising:

a heat exchanger configured to transfer heat from a vehicle system; and a powered fan constructed and arranged to move air past the heat exchanger, the fan including a plurality of radially-extending fan blades configured to produce an airflow when rotated about a rotational axis, each blade having a chord length distribution, stagger angle and dihedral distance which varies along the length of the blade, each blade extending axially downstream from an upstream surface of a hub, wherein each blade joins a circular band concentric with the hub and spaced radially outward from the hub, and wherein the circular band comprises an upstream edge disposed substantially axially downstream from the upstream surface of the hub, and wherein the rate of change of the dihedral distance of a trailing edge of each blade with respect to a radius is substantially between −0.88 and +0.44.

26. The fan of claim 25, wherein there are seven blades spaced evenly around a circumferential portion of the hub.

27. The cooling system of claim 25, further comprising an electric motor, wherein the fan is rotatably supported and powered by the electric motor.

28. The cooling system of claim 25, further comprising a duct for guiding the airflow past the heat exchanger and into the fan.

29. The cooling system of claim 25, wherein the circular band has an L-shaped cross-section taken along a plane passing through the rotational axis.

30. The cooling system of claim 25, in combination with a duct, the circular band being operatively disposed within the duct such that, when the fan is rotated within the duct, an aeromechanical seal is formed.

31. The cooling system of claim 25, wherein the hub, blades and circular band are made integral.

32. A high efficiency axial flow fan for producing an airflow through an engine compartment of a vehicle comprising:

a hub rotatable about a rotational axis, a circular band concentric with the hub and spaced radially outward from the hub, and a plurality of fan blades distributed circumferentially around the hub and extending radially from the hub to the circular band, wherein each blade has substantially the parameters defined by

| R (m) | C (mm) | Θ (deg) | ξ (deg) | Λ (deg) | h (mm) | Range of R over which dh/dr is measured (mm) | dh/dR (mm/mm) |
|---|---|---|---|---|---|---|---|
| 0.075 | 9.08 to 52.19 | 25.0 to 40.0 | 58.73 to 68.73 | −3.0 to 3.0 | −41.71 | 75.00 to 85.00 | −0.690 to −.090 |
| 0.085 | 9.39 to 53.97 | 20.0 to 35.0 | 61.14 to 71.14 | −1.0 to 5.0 | −45.61 | 85.00 to 95.00 | −0.676 to −.076 |
| 0.095 | 9.58 to 55.06 | 18.0 to 33.0 | 60.65 to 70.65 | 1.78 to 7.78 | −49.37 | 95.00 to 105.00 | −0.417 to 0.183 |
| 0.105 | 9.66 to 55.57 | 18.0 to 33.0 | 60.66 to 70.66 | 3.0 to 9.0 | −50.54 | 105.00 to 115.00 | −0.270 to 0.330 |
| 0.115 | 9.71 to 55.82 | 18.0 to 33.0 | 61.17 to 71.17 | 3.0 to 9.0 | −50.24 | 115.00 to 125.00 | −0.234 to 0.366 |
| 0.125 | 9.78 to 56.22 | 18.5 to 33.5 | 62.19 to 72.19 | 2.12 to 8.12 | −49.58 | 125.00 to 135.00 | −0.208 to 0.392 |
| 0.135 | 9.94 to 57.14 | 18.5 to 33.5 | 63.71 to 73.71 | 0.72 to 6.72 | −48.66 | 135.00 to 145.00 | −0.187 to 0.413 |
| 0.145 | 10.25 to 58.93 | 18.0 to 33.0 | 65.27 to 75.74 | −0.82 to 5.18 | −47.53 | 145.00 to 155.00 | −0.160 to 0.440 |
| 0.155 | 10.77 to 61.95 | 18.0 to 33.0 | 68.27 to 78.27 | −2.1 to 3.9 | −46.13 | 155.00 to 162.00 | −0.271 to 0.329 |
| 0.162 | 11.32 to 65.13 | 19.5 to 34.5 | 70.35 to 80.34 | −2.62 to 3.38 | −45.93 | 162.00 to 167.00 | −0.518 to 0.082 |
| 0.167 | 11.88 to 86.31 | 21.0 to 36.0 | 71.97 to 81.97 | −3.2 to 2.8 | −47.02 | — | — |

wherein R is the radial distance in meters from the rotational axis; C is the chord length in millimeters at the radial distance R; Θ is the blade section camber angle in degrees at the radial distance R; ξ is the blade section stagger angle in degrees at the radial distance R; Λ is the skew angle of the chord section in degrees, at the radial distance R, calculated at 30% chord; h is the dihedral distance in millimeters of the downstream edge of the blade, at the radial distance R, from a plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

33. The fan of claim 32, wherein the circular band has a generally L-shaped cross-section taken along a plane passing through the rotational axis.

34. The fan of claim 32, wherein there are seven blades spaced evenly around a circumferential portion of the hub.

35. The fan of claim 32, in combination with a duct, the circular band being operatively disposed within the duct such that, when the fan is rotated within the duct, an aeromechanical seal is formed.

36. The fan of claim 32, wherein the hub, blades and circular band are made integral.

* * * * *